United States Patent [19]

Kalns

[11] 4,068,990

[45] Jan. 17, 1978

[54] CONCRETE SLAB FORMING MACHINE

[76] Inventor: Arvids Kalns, 541 Central Ave., Albany, N.Y. 12206

[21] Appl. No.: 670,883

[22] Filed: Mar. 26, 1976

[51] Int. Cl.[2] ..... B28B 13/02

[52] U.S. Cl. ..... 425/64; 425/432

[58] Field of Search ..... 425/63-64, 425/219, 432, 456; 404/105, 106; 222/238, 252, 272

[56] References Cited

U.S. PATENT DOCUMENTS

| | | | |
|---|---|---|---|
| 321,030 | 6/1885 | Hutchison | 222/252 |
| 3,143,781 | 8/1964 | Kalns | 425/432 |
| 3,143,782 | 8/1964 | Kalns | 425/432 |
| 3,208,362 | 9/1965 | Sigmund | 425/64 |
| 3,224,064 | 12/1965 | Hummel et al. | 425/456 |
| 3,401,438 | 9/1968 | Dennis | 425/432 |
| 3,583,046 | 6/1971 | Dickinson et al. | 425/432 |
| 3,826,411 | 7/1974 | Kalns | 425/64 |

*Primary Examiner*—Francis S. Husar
*Assistant Examiner*—John McQuade
*Attorney, Agent, or Firm*—Bruns & Jenney

[57] ABSTRACT

A machine for forming concrete slabs by a continuous process without using conventional casting forms. This requires that the consistency of the concrete mix be such that the concrete will be self-supporting before it has hardened. The machine to be disclosed is designed to utilize self-supporting concrete mixes of the optimum consistency, and enables close control of the forming process at each phase of the operation. The machine includes a carriage that is advanced by winch and cable along a track over a flat surface. A portion of the carriage coacts with the flat surface to form a mold cavity, and concrete mix from a hopper mounted on the carriage is delivered to the cavity by a novel feed and packing arrangement. Vibration means are associated with the mold cavity to consolidate the concrete mix and improve its flow.

11 Claims, 6 Drawing Figures

CONCRETE SLAB FORMING MACHINE

BACKGROUND OF THE INVENTION

This invention relates generally to concrete slab forming machines, and has particular reference to an improved machine for forming high quality concrete slabs by a continuous process without the use of conventional casting forms.

Forming slabs by a continuous process without forms requires a concrete mix of a consistency such that the concrete section that is formed will be self-supporting before the concrete has hardened. In concrete technology, such concrete mixes are defined as "zero slump" and "low slump" (up to 3 cm ± slump) mixes.

"Zero slump" (dry state) mixes are highly abrasive and cause excessive wear on the forming machinery. An even more serious disadvantage, however, is the lack of cement-sand paste in such mixes which prevents the achievement of a good bond between the concrete and any reinforcing steel there may be.

"Low slump" (plastic state) mixes produce structurally sound concrete with far less wear on the machinery and good reinforcing steel-concrete bonding. However, with such mixes there may be some sagging or slumping in the freshly formed section resulting in an inferior product.

Between these extremes of workable consistency limits, there is a range where the concrete mixes have optimum characteristics and mixes in this range are defined as "zero slump saturated" mixes. These mixes have a practical water variance flexibility and combine the advantages of the "zero slump" stiffness after the forming stage (inside and outside the machinery) and "low slump" workability during the forming stage.

At the present time, concrete slab forming machines can be broadly classified as extrusion type and slip form type machines. The extrusion type machines exert a force on the concrete mix to extrude it through the forming part of the machine. When the extruded concrete section reaches a certain resistance (weight), the reaction of the extrusion force propels the forming machine ahead. Within the extrusion machine classification there are screw type and reciprocating type machines.

Screw type extrusion machines can use only "zero slump" concrete mixes because the mix must be stiff to transmit the longitudinal extrusion force from the cylindrical envelopes of the augers to the rectangular shape of the concrete section. If water were added to the mix to improve its bond with reinforcing steel, the mix would very possibly plug the augers. To achieve the necessary cement-sand paste for good bonding when using this type of machine, water from the floor is vibrated in the bottom of the concrete section. This, however, results in different densities between the top and bottom of the slab which causes excessive camber/deflection problems.

Reciprocating type extrusion machines can use concrete mixes from "zero slump" through "low slump" consistencies. However, because of the stop and go that is necessitated by the feed and extrude cycles, these machines have the disadvantage of relatively low production speed. U.S. Pat. No. 3,159,897 to Ellis discloses a screw type machine, while U.S. Pat. Nos. 3,143,718 and 3,143,782, both to Kalns, disclose reciprocating type machines.

Slip form type slab forming machines, unlike the extrusion type, do not apply any force to extrude, or to pack the concrete mix into the forming part of the machine. These machines are propelled by external means such as a power wheel or winch and the concrete mix is moved by gravity and vibration into the forming part of the machine. To enable the mix to flow, and to minimize the friction between the forms and concrete, the mix must be in the wet range (2 cm ± slump) of the low slump consistency resulting in an inferior product. In addition to this disadvantage, the gravity feed frequently is not uniform due to the practical limitations in controlling the concrete mix. Water and aggregate changes influence the flow characteristics of the wet concrete mix and thus impair the uniformity of the product. Concrete mixes of even medium consistency (1 cm ± slump) cannot be used in the slip form machinery because of the lack of a force to compensate for the friction between the forms and concrete mix, i.e. such mixes plug up the machinery.

Slip form type slab forming machines are disclosed in U.S. Pat. Nos. 3,401,438 to Dennis; 3,583,046 to Dickinson; 3,608,011 to Jones and 3,647,308 to Yost.

SUMMARY OF THE INVENTION

The machine to be disclosed herein is an improved machine for forming high quality concrete slabs by a continuous process without the use of conventional casting forms. While similar in some respects to the machine disclosed in applicant's own U.S. Pat. No. 3,143,782, the machine of the invention is neither an extrusion type nor a slip form type machine but does incorporate some of the best features of both.

The present machine is adapted for use with the full range of self-supporting concrete mixes, from "zero slump" through "low slump" consistencies, which means that it can utilize the optimum consistency mixes, i.e. "zero slump saturated" through 1 cm ± slump mixes. At the same time, the machine permits close control of the forming process at each phase of the operation. Higher production speeds can be achieved due to the power controlled feed and packing of the concrete mix in the forming part of the machine and by the provision of a horizontal force that counteracts the friction force between the mix and the forming part of the machine. The latter also minimizes the possibility of having the mix plug up the machine.

The machine of the invention includes a carriage that is advanced by winch and cable along a track over a flat surface. A portion of the carriage coacts with the flat surface to form a mold cavity, and concrete mix from a hopper mounted on the carriage is delivered to the cavity by a pair of power operated feed and packing rotors. The rotors are located with respect to the mold cavity and any core members that may be disposed therein so as to insure that the concrete mix fully occupies the available space in the cavity and is of uniform density throughout.

DESCRIPTION OF THE PREFERRED EMBODIMENT

Figure 1:
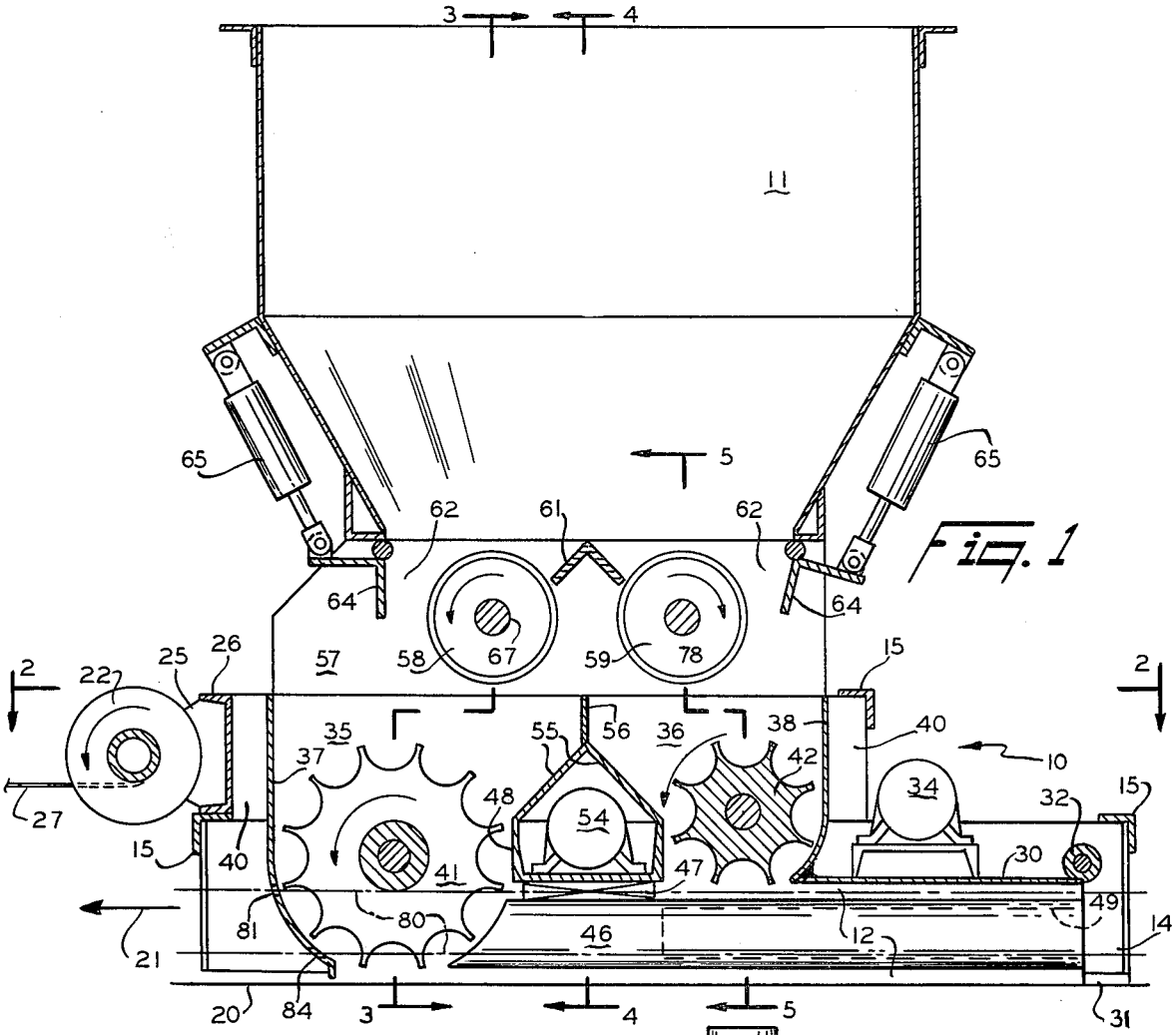
FIG. 1 is a vertical, longitudinal sectional view of a concrete slab forming machine embodying the invention, the view being essentially diagrammatic.
Figure 2:
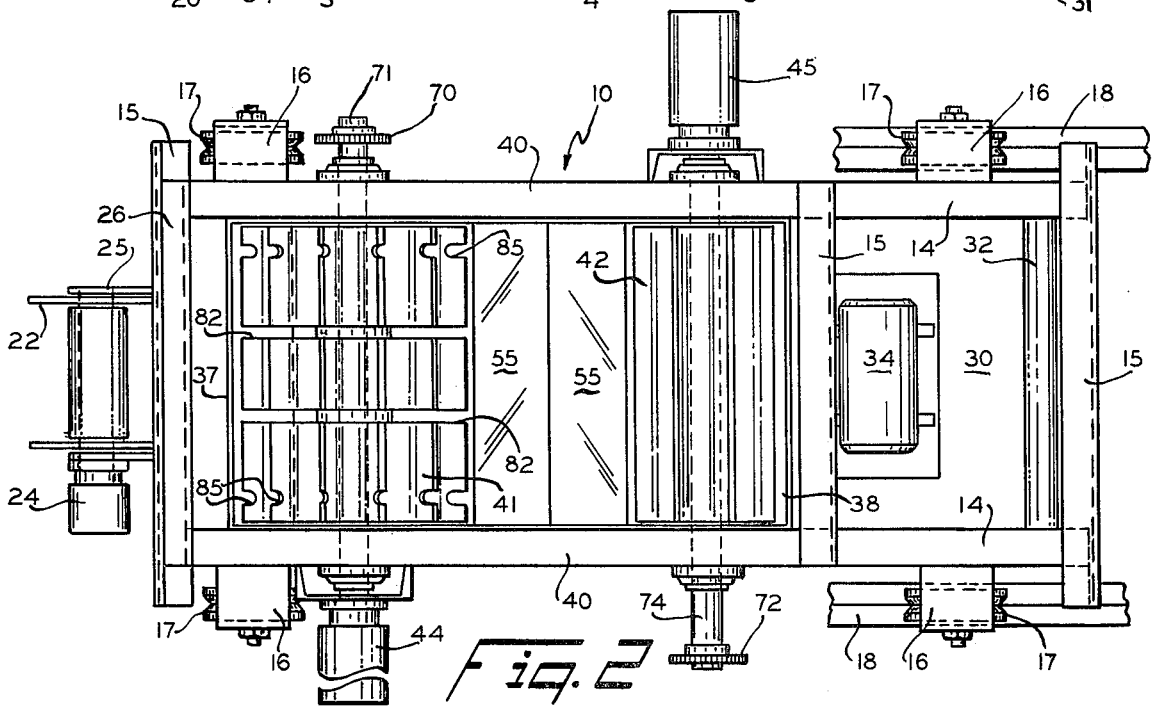
FIG. 2 is a horizontal sectional view of the machine taken substantially on line 2—2 of FIG. 1.

Referring now to the drawings, and with particular reference to FIGS. 1 and 2, the concrete slab forming machine is essentially comprised of a carriage, generally indicated by reference number 10, a hopper 11 for concrete mix mounted on the carriage, and feed and packing means to be described for conveying mix from the hopper to a mold cavity 12 which forms a part of the carriage. The lower part of the carriage comprises a pair of hollow structural side members 14 that are secured together in spaced, parallel relation by L-beams 15 and other components to be described.

Secured to the outside of each side member 14 is a pair of brackets 16 in which are journalled wheels 17 that ride on rails 18, the rails forming a track for the carriage supported by a flat surface 20. In forming a concrete slab, the forming machine travels from right to left as shown by arrow 21 in FIG. 1, and movement is effected by a winch 22 that is powered as by a hydraulic motor 24, FIG. 2. Winch 22 is supported by plates 25 that project from a channel beam 26, the beam being secured to an L-beam 15 at the forward end of the carriage. Counterclockwise rotation of the winch causes a cable 27 that is anchored at the end of the track to be wound on the drum of the winch.

Figure 4:
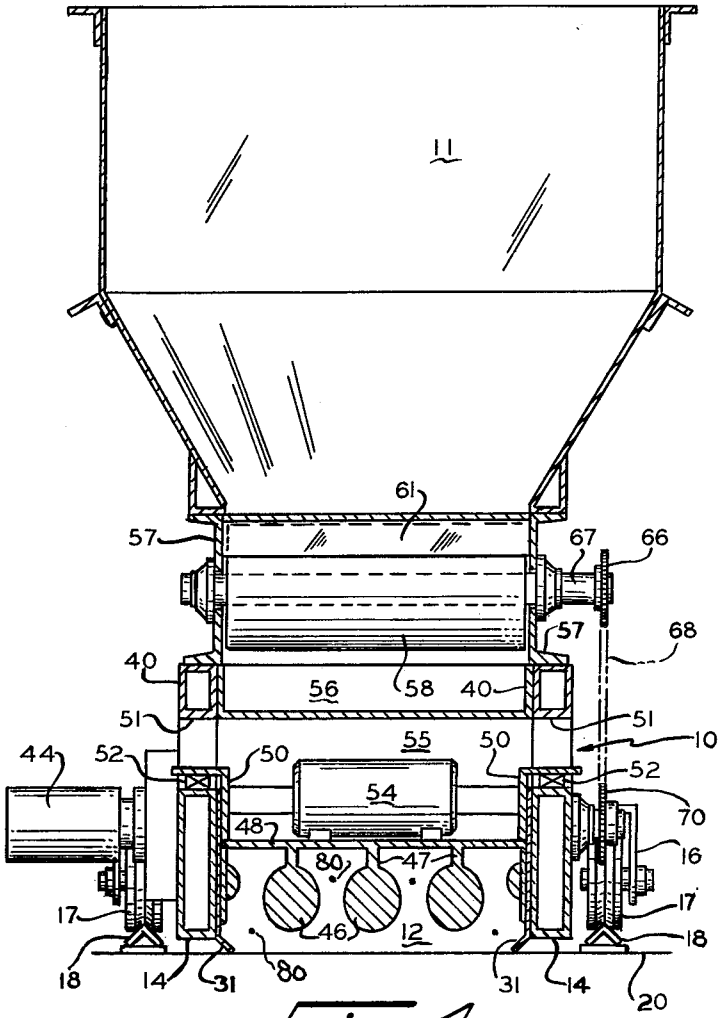
FIGS. 3, 4 and 5 are vertical, transverse sectional views of the machine taken respectively substantially on lines 3—3, 4—4 and 5—5 of FIG. 1.
Figure 6:
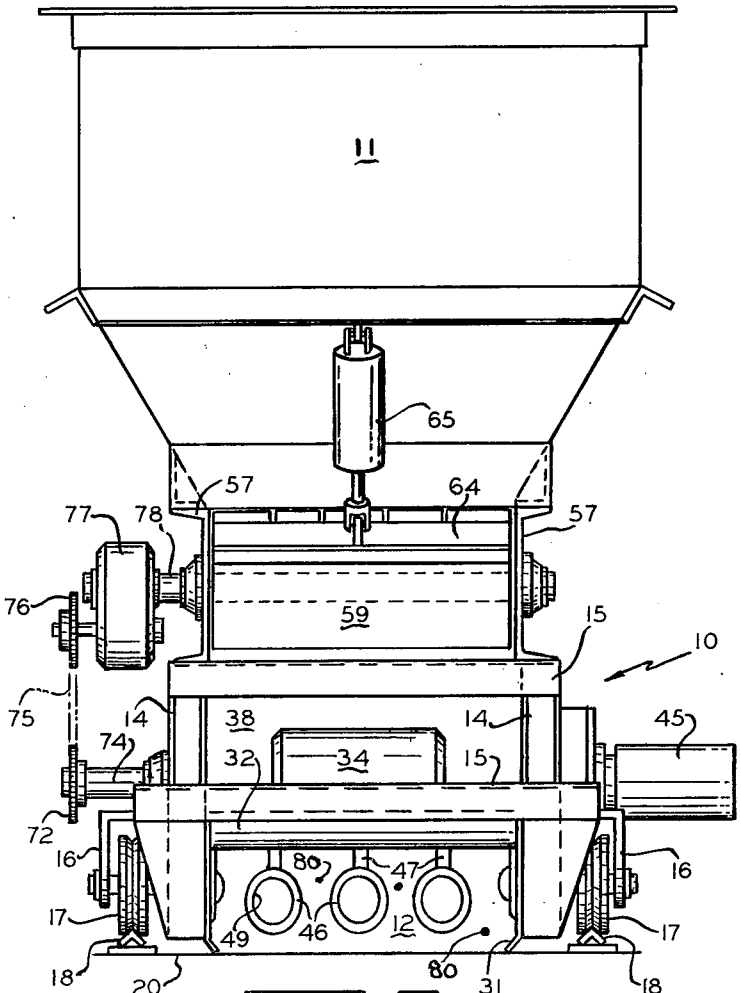
FIG. 6 is a right end elevation of the machine of FIG. 1.
Figure 5:
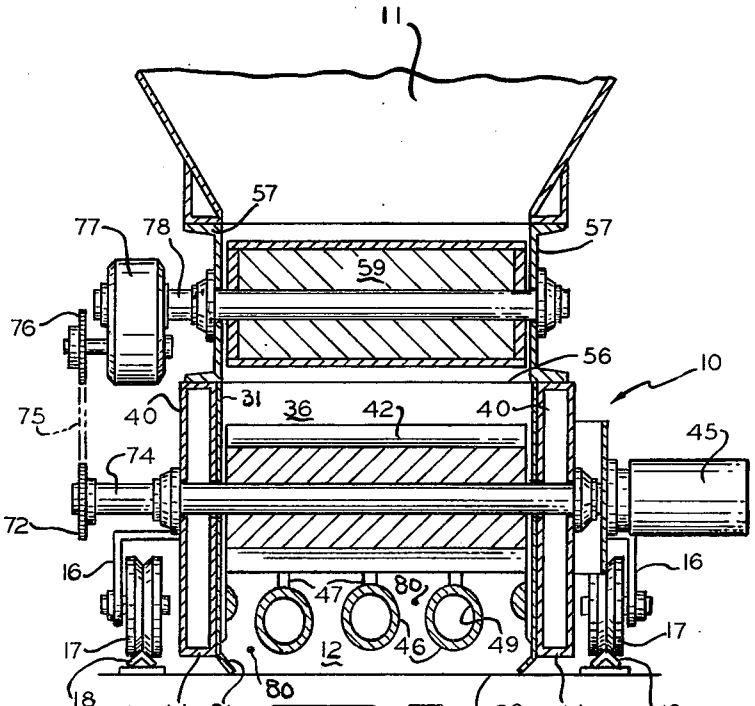

Within the carriage 10 the mold cavity 12, FIGS. 1, 5 and 6, is defined by the inside walls of the side members 14, a top plate 30 and the flat surface 20. To this end, as shown in FIGS. 3–6, the side members 14 extend downwardly almost to the surface 20. Secured to the inside surfaces of the members 14 are thin sheets of steel 31 that extend below the lower edges of the members and close the spaces between the members and the surface 20. The top plate 30 spans the distance between side members 14 and is pivotally connected to the members at 32. The forward end of the plate is supported by means (not shown) that permit the plate to be vibrated by a vibrator 34 of conventional construction.

Communicating with the mold cavity 12 and forward thereof are dual rotor chambers 35, 36 formed by front and rear walls 37, 38 and side walls 31. The rotor chambers are positioned between and supported by the side members 14 and a second pair of hollow structural members 40 that are respectively secured to the upper edges of the side members 14, FIGS. 1 and 3. A primary rotor 41 is mounted as shown in rotor chamber 35 and a secondary rotor 42 is mounted as shown in chamber 36, the rotors being driven in a manner to be described by hydraulic motors 44, 45, respectively.

In the embodiment of the invention disclosed, a plurality of core members 46 are positioned in the rotor chambers and mold cavity 12, the cores being disposed in spaced, parallel relation to each other and to the side members 14, top plate 30 and flat surface 20. Each core is connected adjacent its forward end by a hanger arm 47 to a common support member in the form of a channel beam 48 that extends transversely between the side members 14. The rear portion of each core is hollow as indicated at 49 to lighten its weight.

At each end of the beam 48, FIG. 4, there is an L-shaped support member 50 the horizontal leg of which extends outwardly through a cut-out 51 in the confronting structural member 40 so as to overlie and be supported by the adjacent side member 14, there being an intermediate resilient member 52 between the horizontal leg and side member as shown. This permits the beam 48 and thus the cores 46 to be vibrated by a vibrator 54 mounted on the beam. The vibrator is shielded from concrete mix entering the rotor chambers by converging walls 55 secured to the upper edges of the beam 48. These walls, together with the beam and an upper vertical wall 56, separate the rotor chambers 35 and 36.

As best shown in FIGS. 3–6, a longitudinally extending channel beam 57 is secured to the upper edge of each side member 40 and these in turn support the hopper 11 for the concrete mix. Primary and secondary feed rollers 58, 59 are journalled in the beams 57 below the open bottom of the hopper and these rollers are arranged to rotate in opposite directions as shown by the arrows thereon. An inverted V-shaped beam 61 extends transversely between the beams 57 and between the feed rollers to prevent the mix from passing between the rollers. With this construction, the hopper has two outlets 62 each provided with a hinged gate 64 for controlling the amount of mix that passes through the outlet. The position of each gate is controlled by a hydraulic cylinder 65.

Figure 3:
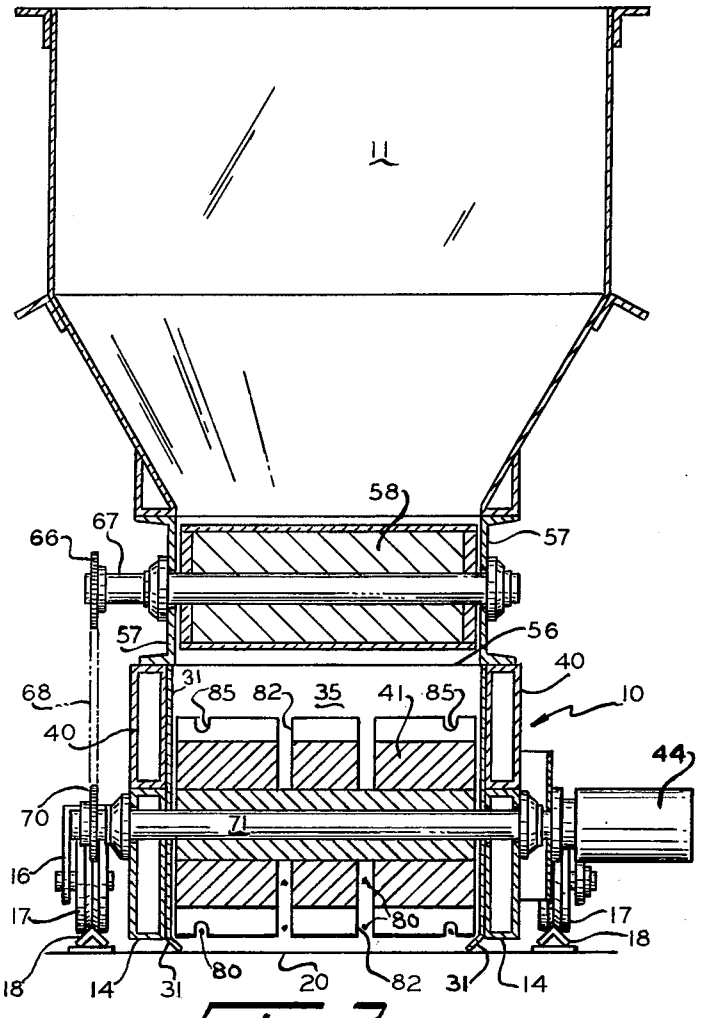

The primary feed roller 58 has a sprocket 66, FIG. 3, connected to one end of its shaft 67, and this is connected by a chain 68 to a sprocket 70 on the end of the primary rotor shaft 71 whereby the feed roller is driven in the same direction as the primary rotor. In a similar manner, a sprocket 72, FIGS. 5 and 6, on the end of the secondary rotor shaft 74 is connected by a chain 75 to a sprocket 76 on a direction reversing gear box 77 that is in turn connected to the shaft 78 of the secondary feed roller 59. The latter is thus driven in the opposite direction from the secondary rotor.

Since the concrete slabs usually have reinforcing rods or strands incorporated therein, strands 80 are shown in phantom lines in FIG. 1 to illustrate their disposition in relation to the forming machine. The opposite ends of these strands are anchored at the opposite ends of the track with the strands stretching (usually under tension) therebetween. In the embodiment of the invention shown, provision is made for two upper and up to four lower strands. The upper strands pass through holes 81 in the front rotor chamber wall 37, through annular grooves 82, FIG. 2, in the primary rotor 41 and below the core support member 48, secondary rotor 42 and top forming plate 30. The lower strands pass through holes 84 in rotor chamber wall 37, through annular grooves 82 and 85, FIG. 3, in rotor 41 and between the spaced core members 46.

In operation, concrete mix of the desired consistency is deposited in the hopper 11, and at this time the control gates 64 are closed. Thereafter, the hydraulic motors 44, 45 are started causing rotors 41, 42 and feed rollers 58, 59 to rotate in the directions indicated by the arrows. Upon opening the gates 64, the mix is fed by roller 58 into rotor chamber 35 and by roller 59 into rotor chamber 36.

The primary rotor 41 operates to pack the concrete mix below, between and above the cores 46 and at the same time shears off the mix at the peripheries of the forward ends of the cores thereby eliminating any tearing effect. The primary rotor also operates to shear off the concrete mix at the lower forward edge of the core support member 48. In its rotation and packing of the mix, rotor 41 produces a horizontal component of force that counteracts the frictional force (tearing action)

between the concrete mix and forming parts of the machine.

While the primary rotor is functioning as described, the vibrator 54 on the core supporting beam 48 operates through the beam and the cores to consolidate the concrete mix and improve its flow.

The secondary rotor 42 operates to pack the concrete mix between and above the cores 46 and below the top forming plate 30. The rotor also shears off the mix at the forward edge of plate 30 to eliminate tearing effect and, like rotor 41, produces a horizontal component of force that helps to counteract frictional forces. While the secondary rotor is functioning in this manner, vibrator 34 operates through the top forming plate to consolidate the concrete mix and improve its flow.

During the above described operation of the rotors and vibrators, the machine is not moving along the track. After the rotors have achieved their full packing capacity, the winch motor 24 is actuated and operates through the cable 27 to give the machine an increment of forward movement. The over-all speed with which the machine advances along the track depends upon the speed with which the rotors 41, 42 perform the work described above. The three main machine functions, i.e. the operation of the primary rotor 41, secondary rotor 42 and winch 22, are controlled by separate hydraulic flow controls thereby providing the operator with the means to accommodate any variations in the characteristics of the concrete mix.

While a particular embodiment of the invention has been described, it will be understood that cores 46 can be omitted to produce a solid slab. It should also be noted that a contoured top forming plate can be substituted for the flat plate 30 to produce a slab having a contoured upper surface such as a T-beam or channel.

From the foregoing description it will be apparent that the invention provides a very advantageous concrete slab forming machine that represents a substantial improvement over the machines of the prior art. As will be understood by those familiar with the art, the invention may be embodied in other specific forms without departing from the spirit or essential characteristics thereof.

I claim:

1. A concrete forming machine adapted for movement along a track over a flat surface comprising a carriage a portion of which coacts with the flat surface to form a mold cavity, a plurality of core members disposed longitudinally in the cavity in spaced parallel relation to each other, a hopper for a concrete mix mounted on the carriage, primary feed means in the carriage for delivering concrete mix from the hopper to an area adjacent the forward ends of the core members and for packing the mix above, below and between the members, said primary feed means having a portion thereof extending in front of the forward ends of and below the upper surfaces of the core members, secondary feed means in the carriage for delivering concrete mix from the hopper to an area above the core members at a point spaced rearwardly from the forward ends thereof and for packing the mix above and between the members, and power means on the carriage for advancing it along the track.

2. A machine as defined in claim 1 wherein the hopper has two outlets and a feed roller associated with each outlet, one of the rollers operating to deliver concrete mix to the primary feed means and the other roller operating to deliver concrete mix to the secondary feed means.

3. A machine as defined in claim 1 wherein the power means for advancing the carriage comprises a winch mounted at the forward end of the carriage.

4. A machine as defined in claim 1 wherein the core members are supported in the cavity by a common support member, the machine including means operatively associated with said support member for vibrating the support member.

5. A machine as defined in claim 4 wherein the common support member and vibrating means are positioned in the carriage between the primary and secondary feed means.

6. A concrete forming machine adapted for movement along a track over a flat surface comprising a carriage having a top plate spaced above the surface and a pair of side members the lower edges of which terminate in close proximity to the surface, the top plate, side members and surface forming a mold cavity, a plurality of core members disposed longitudinally in the cavity in spaced parallel relation to each other, a common support for the core members, the support being mounted in the carriage and connected to each core member adjacent the forward end thereof, a hopper for a concrete mix mounted on the carriage above the mold cavity, primary feed means in the carriage for delivering concrete mix from the hopper to an area adjacent the forward ends of the core members and for packing the mix above, below and between the members, said primary feed means having a portion thereof extending in front of the forward ends of and below the upper surfaces of the core members, secondary feed means in the carriage for delivering concrete mix from the hopper to an area above the core members at a point spaced rearwardly from the forward ends thereof and for packing the mix above and between the members, and power means on the carriage for advancing it along the track.

7. A machine as defined in claim 6 wherein the hopper has two outlets and a feed roller associated with each outlet, one of the rollers operating to deliver concrete mix to the primary feed means and the other roller operating to deliver concrete mix to the secondary feed means.

8. A machine as defined in claim 6 wherein the power means for advancing the carriage comprises a winch mounted at the forward end of the carriage.

9. A machine as defined in claim 6 wherein the common support for the core members is positioned in the carriage between the primary and secondary feed means.

10. A machine as defined in claim 6 including means operatively associated with said carriage for vibrating the top plate and core member support.

11. A machine as defined in claim 6 wherein the primary and secondary feed means are rotors having generally hypocycloidal cross sections, the rotor of the primary feed means having annular grooves therein to permit reinforcing means to extend through the rotor.

* * * * *